United States Patent [19]

Sheehan

[11] 4,283,034

[45] Aug. 11, 1981

[54] CURTAIN ROD BRACKET CONSTRUCTION

[75] Inventor: Maurice J. Sheehan, Ocean Bluff, Mass.

[73] Assignee: Edward F. McBride, St. Petersberg, Fla. ; a part interest

[21] Appl. No.: 74,129

[22] Filed: Sep. 10, 1979

[51] Int. Cl.[3] ..... A47M 1/10

[52] U.S. Cl. ..... 248/263; 248/DIG. 9; 248/546

[58] Field of Search ..... 248/546, 216.4, 262, 248/263, 269, 265, 267, 268, 270, 254, 255, 256, 257, 258, 259, 260, 271, 272

[56] References Cited

U.S. PATENT DOCUMENTS

| | | | |
|---|---|---|---|
| 1,520,857 | 12/1924 | Courtois | 248/262 |
| 1,961,728 | 6/1934 | Arnest et al. | 248/DIG. 6 |
| 2,328,421 | 8/1943 | Carlson et al. | 248/DIG. 6 |
| 2,679,373 | 5/1954 | Henley | 248/267 X |
| 2,848,184 | 8/1958 | Kennedy | 248/263 |

FOREIGN PATENT DOCUMENTS

| | | | |
|---|---|---|---|
| 691319 | 7/1964 | Canada | 248/263 |
| 826781 | 4/1938 | France | 248/267 |

*Primary Examiner*—J. Franklin Foss

*Attorney, Agent, or Firm*—Salter & Michaelson

[57] ABSTRACT

A bracket construction for mounting curtain rods and the like to a conventional wooden molding which eliminates the conventional need for screws or nails. The bracket includes an essentially flat base plate from which a pair of opposed curtain rod receiving arms project forwardly and a top flange which projects rearwardly from the top edge of the base plate and is furthermore provided with downwardly projecting tangs. The flange is adapted to contact upper edge portions of the molding and the tang adapted to project thereinto so as to support the bracket in the desired position on the molding. In addition, a side tab rearwardly projects from the base plate and is adapted to contact the side edge or end wall of the molding so as to mount the bracket at the molding extremity. Normally a pair of such brackets are utilized in conjunction with each other, as for mounting at opposite ends of the molding and in one embodiment of the invention to a pair of such brackets are made joined to each other at their bottom edges along a weakened line so that they may be disconnected for use. In addition, the flange and tab of the brackets, whether the brackets are formed individually or in pairs as above-described, may be readily removed from the base plate so that the bracket may be conventionally attached to the molding by screws or the like, when desired.

3 Claims, 8 Drawing Figures

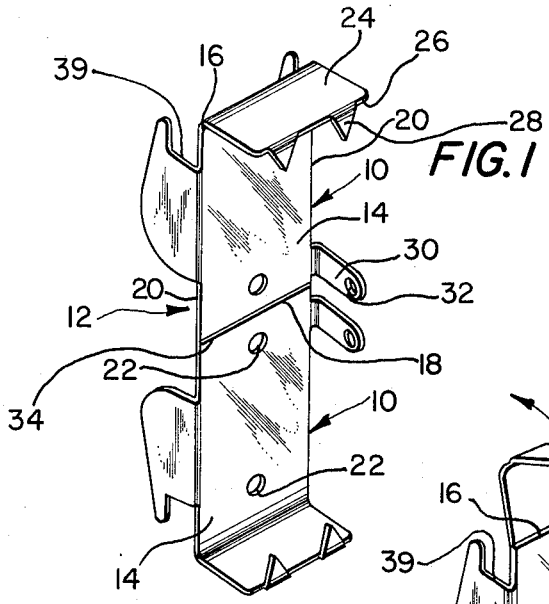
FIG. 1
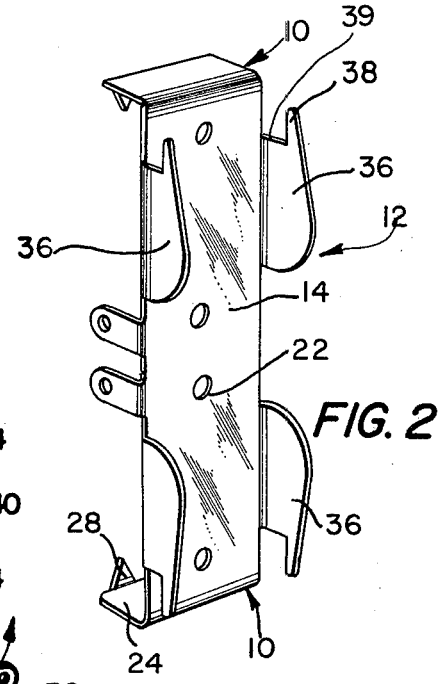
FIG. 2
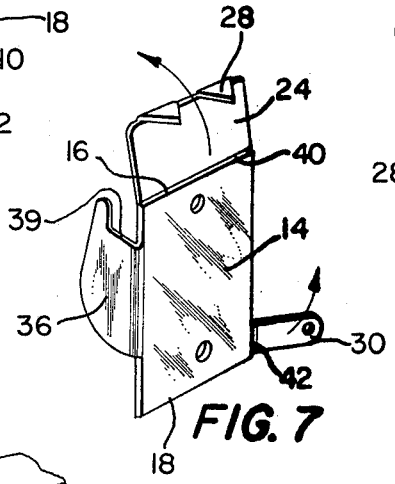
FIG. 7
FIG. 3
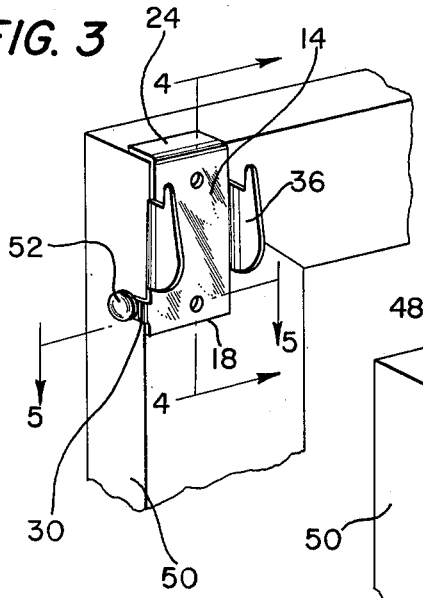
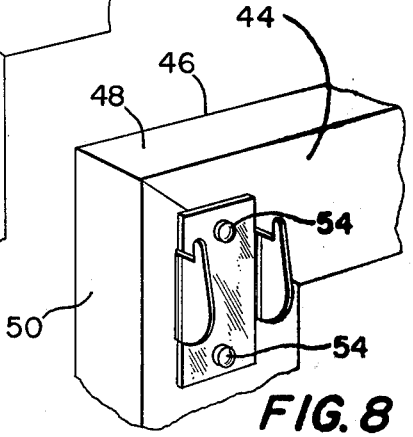
FIG. 8
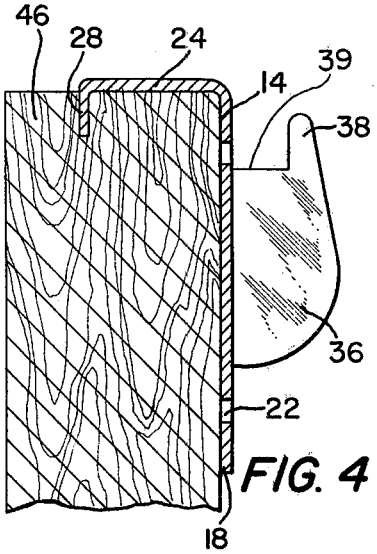
FIG. 4
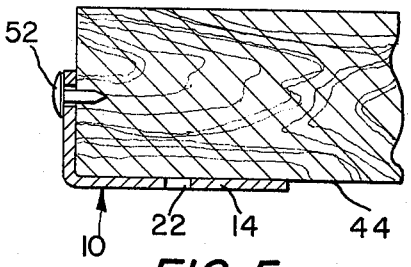
FIG. 5
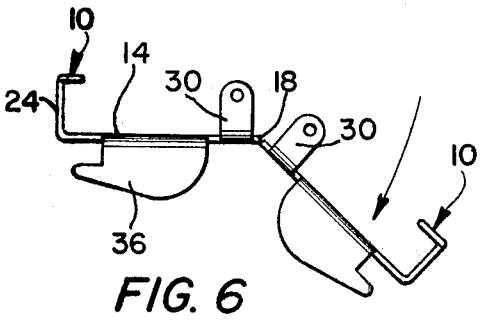
FIG. 6

CURTAIN ROD BRACKET CONSTRUCTION

BACKGROUND AND SUMMARY OF THE INVENTION

This invention relates to a bracket for attachment to wall moldings and the like such that rod-like elements, i.e. curtain rods, may be supported thereby. Brackets of this type are well-known and include an essentially flat base plate having a pair of spaced openings to receive nails, screws and the like such that the plate may be affixed to opposite ends of a window molding. Such brackets include a pair of forwardly projecting rod receiving arms on which curtain rods are supported. A problem in utilizing brackets of such known construction is that the nails or screws cause holes in the molding and after several repositionings as may be required over the years, the molding may become honeycombed or even split. This makes it increasingly difficult to mount new pairs of curtains, draperies, or the like on to the molding.

It is accordingly an object of the present invention to provide a bracket which when used to support curtain rods and the like from wooden and other moldings does not require screws or nails for such attachment to the molding.

In addition, since such brackets are normally used in pairs with one of each pair at opposite ends of a molding, it is also an object of the present invention to provide a construction wherein a pair of such brackets may be manufactured as a single unit with means permitted ready separation of the brackets for use.

These and other objects of the present invention are accomplished by the provision of a bracket comprising an essentially flat base plate. The top edge of such plate includes a rearwardly extending flange adapted to contact upper edge portions of the molding while the rear surface of the plate is adapted to contact the front face thereof. In addition, the flange includes a downwardly extending tang which is adapted to dig or bite into the material from which the molding is formed so as to securely position the bracket thereon. In order to further properly position the bracket, the plate is additionally provided with a rearwardly extending tab adapted to contact side or end portions of the molding. Both the flange and the tab are attached to the plate by weakened lines wherein repeated bending of the tab or flange at said lines will permit removal of same from the plate so that the plate can be alternatively conventionally attached to the wall molding by screws or nails, if desired. In one form of the invention, a pair of brackets structured for use on opposite sides of a molding, i.e. a left and right side, are formed together by a temporary attachment along a weakened line connection at their bottom edges, whereby where separated, left end and right end brackets are automatically provided.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention:

FIG. 1 is a rear perspective view of one form of the present invention wherein a pair of curtain rod brackets are simultaneously formed together;

FIG. 2 is a perspective view similar to FIG. 1 but taken from the front thereof;

FIG. 3 is a perspective view showing one of the brackets of the present invention mounted on a window molding in the intended manner;

FIG. 4 is a cross-sectional view taken along the line 4—4 of FIG. 3;

FIG. 5 is a cross-sectional view taken along the line 5—5 of FIG. 3;

FIG. 6 is an elevational view of the construction shown in FIGS. 1 and 2 showing the manner in which the individual brackets may be separated from each other;

FIG. 7 is a perspective view showing how the top flange and side tab of a bracket may be removed such that the bracket may be used in a conventional manner; and FIG. 8 is a perspective view showing how the bracket formed in FIG. 7 may be conventionally mounted to a molding.

DESCRIPTION OF THE INVENTION

Turning now to the drawing and particularly FIGS. 1 and 2 thereof, a particular embodiment of the present invention wherein a pair of brackets 10 are disposed in end to end connected relationship with each other to form a bracket pair assembly 12 is depicted. Each bracket 10 includes an essentially flat base plate 14 having top and bottom edges 16 and 18 respectively and opposed side edges 20. A pair of vertically spaced openings 22 are disposed through the plate and may be used in a manner as hereinafter will be more fully explained. The top edge 16 of the plate is provided with a rearwardly extending flange 24 which in turn terminates in a rear edge 26 from which a pair of downwardly extending tangs 28 extend. Such tangs 28 are generally triangularly shaped, i.e. they downwardly project and terminate in a point. In addition, one of the side edges 20 is provided with a rearwardly extending tab 30 which includes an opening 32 therethrough. Generally, the angular attitude of the flange 24 and the tab 30 with respect to the plate 14 is a right angle relationship, i.e. normal to the plane formed by the base plate 14.

As illustrated, a pair of brackets 10 form a bracket assembly 12 through the connection of such brackets at their respective lower edges 18 along a weakened line 34. In this regard, it should be pointed out the individual brackets 10 when formed separately and the bracket assembly 12 are preferably formed from a single piece of metallic sheet stock, i.e. brass or other suitably formable material. Such sheet is then die cut to size and bent into the appropriate shape as above explained so as to form a bracket or brackets as the case may be.

Each bracket is provided with a pair of laterally spaced rod supporting arms 36 which forwardly project from the front face of the plate 14 and upwardly terminate in narrowed finger portions 38. Such finger portions 38 are adapted for receipt in a pair of spaced openings within curtain rods and the like (not shown) so as to support such at the opposite ends thereof, or in the alternative, said rods are supported on edges 39 in a conventional manner. Generally the weakened line 34 is formed by coining or scoring so as to present a reduced thickness line which when appropriately worked as by repeated or even a single bending of the bracket pair of the assembly 12 with respect to each other as shown in FIG. 6 will serve to break the weakened line and thus disconnect the brackets 10 from each other. Similarly, the flange 24 and the tab 30 of each bracket 10 are provided with weakened lines 40 and 42 respectively. The weakened lines 34, 40 and 42 are preferably provided in the rear face of the base plate 14, that is, that side of the bracket adapted for engagement with the front face 44 of a molding 46. The molding is also provided with generally planar top edge and side edge surfaces 48 and 50 respectively.

In order to mount one of the brackets 10 upon a molding 46, the appropriate bracket 10, i.e. left or right hand, for the particular molding edge to which it is to be attached, is placed against the front face 44 with the tab 30 thereof aligned with the side surface 50 of the molding (illustrated in FIG. 3). It should be understood that such tab 30 is positioned on the left hand side of a bracket 10 adapted for positioning on the left side of a molding and on the right hand side of a bracket adapted for mounting to the right hand side of the molding. Accordingly, the tabs 30 of respective brackets 10 when formed in the interconnected bracket pair assembly 12 shown, are disposed proximate such each other on opposite sides of the weakened line 34, so that when the brackets 10 are separated from each other, a left end and right end bracket are automatically provided. Also as shown in FIG. 3, the opening 32 in the tab may be utilized to receive the shaft portion of a thumb tack 52 which passes therethrough and into the side surface 50 of the molding 46 to assist in attaching the bracket 14 to the molding.

The manner by which the bracket 10 is primarily supported from the molding is, however, through the rearwardly extending flange 24 which is adapted to contact and accordingly rest on the upper edge surface 48 of the molding 46. In this regard, the tangs 28 are additionally adapted to pierce or project into the molding through the surface 48 and thus properly fix the bracket to the molding in the desired position. Such position is of course assisted by the presence of the tab 30.

In this manner, it may be seen that the brackets 10 may be mounted to the molding 46 in the desired manner without the use of any nails or screws passing into the front surface of the molding as in prior art constructions. However, the plate 14 is provided with a pair of spaced openings 22 as previously brought out such that the bracket construction of the present invention may be converted into a conventional structure as by the removal of the tab 30 and the flange 24. Such removal procedure is best shown in FIG. 7 wherein the flange is upwardly forwardly bent about the weakened line 40 while the tab 30 is similarly forwardly and laterally bent about its weakened line 42. Such removal of the flange 24 and tab 30 enables the plate 14 to be disposed in face to face relationship to the front face 44 of the molding as shown in FIG. 8 and affixed thereto by nails or screws 54 passing through the openings 22 and projecting into the molding 46 in the conventional manner.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A bracket construction for mounting curtain rods and the like comprising, an essentially flat base plate having opposed front and rear faces and top, bottom and side edges, said plate adapted for disposition with its rear face against the front face of a molding which forwardly projects as by the thickness thereof from the surface on which said molding is supported, said molding also having top and side edge surfaces, said plate including a pair of laterally spaced supporting arms forwardly projecting from the front face thereof, said plate having combination supporting and positioning means, said means including a supporting flange rearwardly extending at a generally normal attitude from said base plate top edge, said flange adapted to contact the top edge surface of said molding so as to support said bracket thereon, said means further including a positioning tab rearwardly extending from one of said edges of said plate and adapted to contact said adjacent side edge surface of said molding so as to position said bracket adjacent the end of said molding, said flange further including at least one downwardly projecting tang adapted to penetrate said molding top edge surface so as to fix said bracket to said molding, said flange and said tab being connected to respective top and side edges of said plate along weakened lines whereby bending of said flange and said tab with respect to said plate will permit the removal of said flange and said tab from said plate, said plate further including a pair of spaced openings for attaching said plate to said moldings as by nails, screws and the like when said flange and tab have been removed from said bracket.

2. The bracket construction of claim 1, said positioning tab further including an opening through which a tack is adapted to project so as to aid in securement of said bracket to said molding.

3. The bracket construction of claim 1, wherein said base plate, said supporting arms and said combination supporting and positioning means are formed from a single integral material sheet, there being a pair of said brackets adapted for respective attachment at opposite ends of said molding, said pair of brackets being temporarily connected to each of said respective plates, the respective tabs of said attached plates being disposed proximate each other on opposite sides of said weakened line.

* * * * *